US005220888A

United States Patent [19]

Khinkis et al.

[11] Patent Number: 5,220,888

[45] Date of Patent: Jun. 22, 1993

[54] CYCLONIC COMBUSTION

[75] Inventors: Mark J. Khinkis, Morton Grove; Hamid A. Abbasi, Darien, both of Ill.

[73] Assignee: Institute of Gas Technology, Chicago, Ill.

[21] Appl. No.: 889,171

[22] Filed: May 27, 1992

Related U.S. Application Data

[63] Continuation-in-part of Ser. No. 739,209, Aug. 1, 1991.

[51] Int. Cl.[5] ..... F22B 7/12

[52] U.S. Cl. ..... 122/136 R; 122/136 C; 122/160; 431/173

[58] Field of Search ..... 122/136 R, 136 C, 160; 431/9, 173

[56] References Cited

U.S. PATENT DOCUMENTS

| | | | |
|---|---|---|---|
| 3,741,166 | 6/1973 | Bailey | 431/156 |
| 3,837,788 | 9/1974 | Craig et al. | 431/10 |
| 3,859,786 | 1/1975 | Azelborn et al. | 431/173 |
| 3,885,906 | 5/1975 | Shurygin et al. | 431/173 |
| 3,934,555 | 1/1976 | Baumgartner et al. | 431/173 |
| 3,974,021 | 8/1976 | Bernadiner et al. | 431/175 |
| 4,007,001 | 2/1977 | Schirmer et al. | 431/10 |
| 4,021,188 | 5/1977 | Yamagishi et al. | 431/158 |
| 4,297,093 | 10/1981 | Morimoto et al. | 431/10 |
| 4,395,223 | 7/1983 | Okigami et al. | 431/10 |
| 4,575,332 | 3/1986 | Oppenberg et al. | 431/10 |
| 4,860,695 | 8/1989 | Korenberg | 122/149 |
| 4,879,959 | 11/1989 | Korenberg | 431/157 |
| 4,920,925 | 5/1990 | Korenberg et al. | 122/149 |
| 4,989,549 | 2/1991 | Korenberg | 122/149 |
| 5,029,557 | 7/1991 | Korenberg | 122/149 |

*Primary Examiner*—A. Michael Chambers
*Attorney, Agent, or Firm*—Speckman, Pauley & Fejer

[57] ABSTRACT

A process for cyclonic combustion of fuel in a combustor comprising mixing the fuel and oxidant forming a fuel/oxidant mixture prior to injection into said combustor, tangentially injecting the fuel/oxidant mixture into a first combustor chamber, igniting the fuel/oxidant mixture producing combustion products, exhausting the combustion products at a downstream end of a second combustor chamber in fluid communication with the first combustor chamber, and cooling a wall of the second combustor chamber, and an apparatus for carrying out this process.

28 Claims, 5 Drawing Sheets

CYCLONIC COMBUSTION

CROSS REFERENCE TO RELATED APPLICATION

This application is a continuation-in-part of copending U.S. patent application Ser. No. 07/739,209 filed Aug. 1, 1991.

BACKGROUND OF THE INVENTION

1. Field of the Invention

This invention relates to a process and apparatus for cyclonic combustion of fossil fuels, in particular, natural gas, which provides low pollutant emissions as well as high system efficiencies. The process and apparatus of this invention are particularly suited to firetube boilers.

2. Description of the Prior Art

Conventional combustion of fossil fuels in air produces elevated temperatures which promote complex chemical reactions between oxygen and nitrogen in the air, forming various oxides of nitrogen as by-products of the combustion process. These oxides, containing nitrogen in different oxidation states, generally are grouped together under the single designation of $NO_x$. Concern over the role of $NO_x$ and other combustion by-products, such as sulphur dioxide and carbon monoxide, in "acid rain" and other environmental problems is generating considerable interest in reducing the formation of these environmentally harmful by-products of combustion.

In addition to $NO_x$ and carbon monoxide (CO) emissions of total hydrocarbons (THC) and carbon dioxide ($CO_2$) are also of considerable concern. Natural gas is a low emission, high efficiency fuel which can help reduce these emissions. As a result, numerous ultra-low emission, natural gas fired combustion systems are under development.

One of the advanced methods to achieve ultra-low emissions is cyclonic combustion in which a swirl is imparted to both the combustion air and natural gas as they are injected into the combustion chamber, resulting in strong internal combustion products recirculation—both tangential and axial. This inherent recirculation characteristic has been effectively exploited in burner/combustor designs to achieve ultra-low emissions of $NO_x$, CO and THC, high combustion intensity and combustion density, very high combustion efficiency, and high heat transfer to the cooled walls, even at relatively low flame temperatures.

Swirl, or a cyclonic flow pattern, can be imparted to the combustion air and natural gas in several known ways, most notably the use of mechanical swirlers disposed in the nozzle through which the combustion air and/or natural gas are injected into the combustion chamber or the use of tangential injection means for tangentially injecting the combustion air and/or natural gas into the combustion chamber.

There are two major cyclonic combustor designs, adiabatic combustors which, although known to provide high specific heat release, are known to produce high combustion temperatures, and thus high $NO_x$ emissions at low excess air operation, and non-adiabatic combustors, that is, combustors with cooled walls.

U.S. Pat. No. 4,920,925 teaches a boiler having a cyclonic combustor comprising a substantially cylindrical, uncooled and refractory lined primary combustion chamber, a substantially cylindrical secondary combustion chamber in fluid communication with and substantially longitudinally aligned with the downstream end of the primary combustion chamber, means for supplying air and fuel directly into the primary combustion chamber in a manner which forms a cyclonic flow pattern of gases within the primary combustion chamber and the secondary combustion chamber, and a substantially cylindrical exit throat at the downstream end of the secondary combustion chamber aligned substantially concentrically with the secondary combustion chamber for exhausting hot gases from the secondary combustion chamber. The walls of the secondary combustion chamber are cooled. See also U.S. Pat. No. 4,879,959, U.S. Pat. No. 5,029,557, U.S. Pat. No. 4,860,695, and U.S. Pat. No. 4,989,549 which generally teach different types of swirl or cyclonic combustors. See also U.S. Pat. Nos. 3,974,021 and 3,885,906 which teach a process and apparatus for thermal treatment of industrial waste water using cyclonic combustion of fuel in which the walls of the top portion of the combustion chamber are provided with an insulating lining while the walls of the lower portion of the combustor below the level of a burner apparatus are provided with a chilled lining having a circulatory or evaporative water cooling system.

U.S. Pat. No. 3,934,555 discloses a cast iron modular boiler having a cylindrical combustion chamber into which a mixture of gaseous fuel and air is introduced parallel to its longitudinal axis in a manner which imparts a rotational flow around the longitudinal axis. The combustion gases are recirculated internally, thereby causing dilution of gases in the boiler. The combustion chamber is encircled by a water circulation conduit and cooled by a stream of cold water that circulates through the conduit. Heat is removed from the combustion chamber as hot water.

U.S. Pat. No. 4,007,001 teaches a combustion process producing low $NO_x$ emissions by tangentially introducing 0–65% of the total air required for combustion to a primary combustion zone and about 5–25% of the total air required for combustion to a secondary combustion zone where there is an orifice disposed between the primary and secondary combustion zones.

U.S. Pat. No. 3,859,786 teaches a vortex flow combustor having a restricted exit from the combustion chamber.

U.S. Pat. No. 4,021,188 and U.S. Pat. No. 3,837,788 both teach staged combustion with less than the stoichiometric amount of air in the primary combustion chamber with additional air being added to the secondary combustion chamber for completion of combustion.

U.S. Pat. No. 4,575,332 teaches staged combustion in a swirl combustor with forced annular recycle of flue gases to the upstream end of the primary combustion zone.

U.S. Pat. No. 4,395,223 discloses staged combustion with excess air introduced into the primary combustion zone with additional fuel being introduced into the secondary combustion zone.

U.S. Pat. No. 3,741,166 discloses a blue flame burner with recycle of combustion products with low excess air to produce low $NO_x$ while U.S. Pat. No. 4,297,093 discloses a single combustion chamber with a specific flow pattern of fuel and combustion air forming fuel-rich primary zones and fuel-lean secondary zones in the combustion chamber.

SUMMARY OF THE INVENTION

It is one object of this invention to provide a process for cyclonic combustion of fuel which produces ultra-low pollutant emissions, in particular, ultra-low $NO_x$ emissions, at an acceptable thermal efficiency in boilers and heaters.

It is another object of this invention to provide a process for cyclonic combustion of fuel in which the fuel input can be fully modulated between a turned down input and a full capacity input.

It is yet another object of this invention to provide an apparatus which accommodates the process for cyclonic combustion of fuel as described herein.

These objects are achieved by a process for cyclonic combustion of a fuel and an oxidant in which the fuel and oxidant are thoroughly mixed, forming a fuel/oxidant mixture, and the fuel/oxidant mixture is tangentially injected into a substantially uncooled first combustor chamber and ignited, producing combustion products. In accordance with one embodiment of this invention, the combustion products are exhausted through a second combustor chamber which is concentrically aligned and in fluid communication with the first combustor chamber. The walls of the second combustor chamber are cooled. In accordance with another embodiment of this invention, the second combustor chamber is formed by the walls of a firetube in a boiler. Heat transfer is effected by cooling the wall of the second combustor chamber. Although applicable to a wide variety of boilers and heaters, this invention is particularly suited to firetube boilers.

In accordance with one embodiment of this invention, the combustion products are exhausted through a concentrically aligned orifice at the downstream end of said second combustor chamber. In accordance with yet another embodiment of this invention, the combustion products are exhausted from the first combustor chamber into the second combustor chamber through a concentrically aligned orifice at a downstream end of said first combustor chamber.

The critical feature of the process of this invention is the premixing of fuel, preferably natural gas, and oxidant, preferably air, prior to injection into the first combustor chamber. Premixing of the fuel and air minimizes the formation of pockets of higher flame temperatures and oxygen availability, both of which promote higher $NO_x$ formation. Premixing of the fuel and air also intensifies combustion and promotes internal combustion products recirculation.

In accordance with a preferred embodiment of this invention, a diluent selected from the group consisting of air, recirculated flue gases, water, steam and mixtures thereof, is mixed with the fuel/oxidant mixture prior to tangential injection into the first combustor chamber. Premixing of fuel and air allows use of air as a diluent fluid for $NO_x$ control. In non-premixed systems, the use of air above the stoichiometric requirement results in increases in $NO_x$ emissions.

The apparatus for cyclonic combustion of a fuel and oxidant in accordance with one embodiment of this invention comprises a substantially uncooled first combustor chamber having an upstream end, a downstream end and a substantially cylindrical longitudinally extending outer wall. A second combustor chamber having an upstream end, a downstream end, and a substantially cylindrical longitudinally extending outer wall, is in fluid communication with the first combustor chamber, the upstream end of the second combustor chamber being substantially longitudinally aligned with the downstream end of the first combustor chamber. Tangential injection means for tangentially injecting the mixture of fuel and air into the first combustor chamber are secured to the first combustor chamber wall. The tangential injection means further comprise means for premixing the fuel and air prior to injection into the first combustor chamber.

In accordance with one embodiment of this invention, an orifice wall is secured to the second combustor chamber wall proximate the downstream end thereof and has a substantially cylindrical opening concentrically aligned with the second combustor chamber. In accordance with another embodiment of this invention, an orifice wall is secured to the first combustor chamber wall proximate the downstream end thereof and has a substantially cylindrical opening concentrically aligned with the first combustor chamber. In accordance with yet another embodiment of this invention, a first orifice wall is secured to the first combustor chamber wall and a second orifice wall is secured to the second combustor chamber wall, each said orifice wall is disposed at a downstream end of its respective combustor chamber and each said orifice wall is provided with a substantially cylindrical opening concentrically aligned with its respective combustor chamber.

BRIEF DESCRIPTION OF THE DRAWINGS

The above and further objects and advantages of this invention will be apparent from the detailed description of further embodiments and by reference to the drawings wherein.

DESCRIPTION OF PREFERRED EMBODIMENTS

Figure 1:
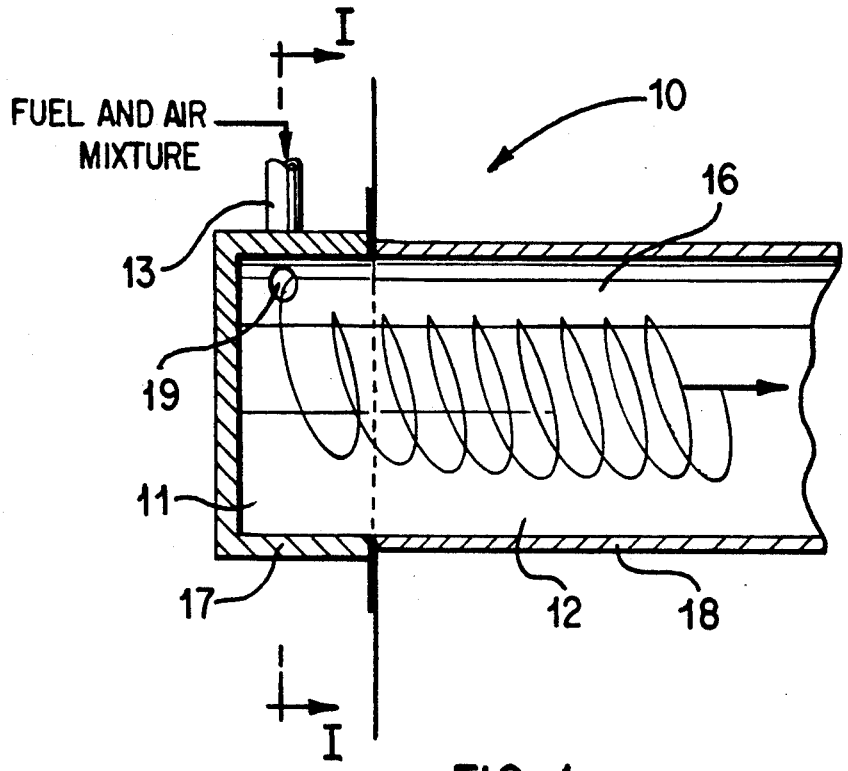
FIG. 1 is a cross-sectional side view of a cyclonic combustor in accordance with one embodiment of this invention.

FIG. 1 shows a cyclonic combustor for a boiler in accordance with one embodiment of this invention. Cyclonic combustor 10 comprises first combustor chamber wall 17 which forms first combustor chamber 11. Connected to first combustor chamber wall 17 is at least one nozzle 13 having an exit end in communication with first combustor chamber 11. A fuel and air mixture is injected into first combustor chamber 11 through nozzle 13, having nozzle exit 19 in communication with first combustor chamber 11. Nozzle 13 is connected to first combustor chamber wall 17 such that a swirl 16 is imparted to the mixture of fuel and air, as well as the products of combustion resulting from the combustion of the mixture, in first combustor chamber 11. First combustor chamber 11 is substantially cylindrical and in fluid communication with second combustor chamber 12 formed by second combustor chamber wall 18. Thus, the hot combustion gases resulting from ignition of the mixture of fuel and air in first combustor chamber 11 pass from first combustor chamber 11 into second combustor chamber 12. First combustor chamber wall 17 is substantially uncooled. However, second combustor chamber wall 18 functions as a heat exchanger, transmitting heat from the hot combustion products in second combustor chamber 12 into a cooling fluid, typically water surrounding second combustor chamber wall 18.

Figure 1A:
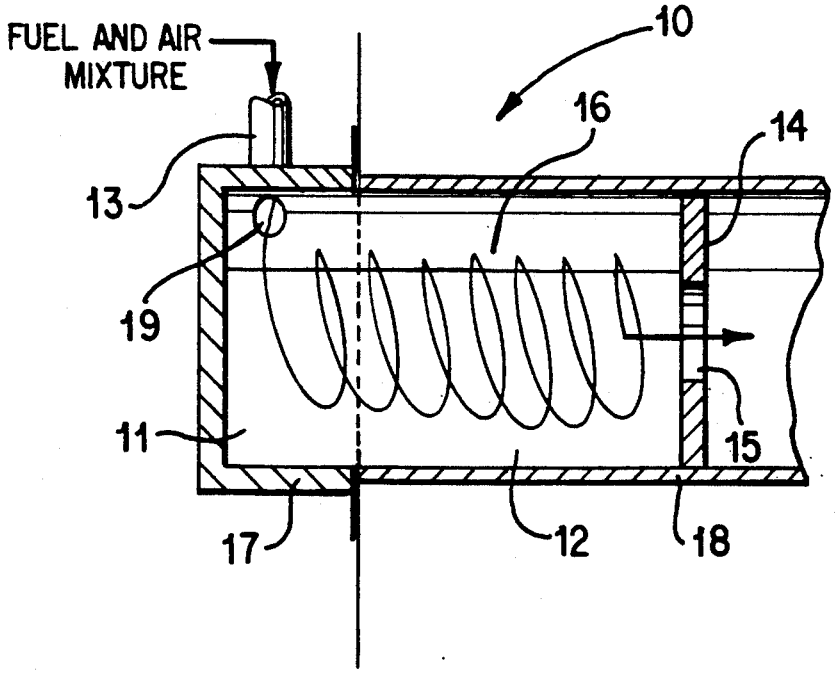
FIG. 1*a* is a cross-sectional side view of a cyclonic combustor in accordance with another embodiment of this invention.

Disposed at the downstream end of second combustor chamber 12 in accordance with one embodiment of this invention, as shown in FIG. 1*a*, is orifice 14 secured to second combustor chamber wall 18 and having opening 15 through which the combustion products from the combustion process are exhausted. The flow restriction provided by orifice 14 enhances the swirling flow pattern as well as the internal recirculation of the combustion products to first combustor chamber 11 within cyclonic combustor 10. As a result of the cooling of second combustor chamber wall 18, the combustion products within second combustor chamber 12 are partially cooled which reduces the flame temperature within first combustor chamber 11 as the partially cooled combustion products are recirculated. Reducing the flame temperature, in turn, reduces $NO_x$ formation.

Figure 1B:
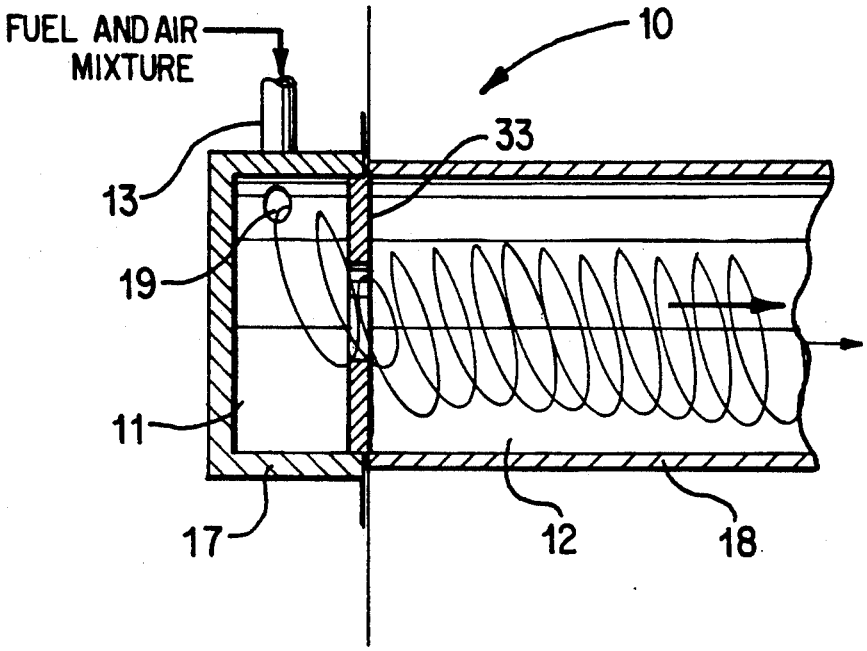
FIG. 1*b* is a cross-sectional side view of a cyclonic combustor in accordance with yet another embodiment of this invention.
Figure 1C:
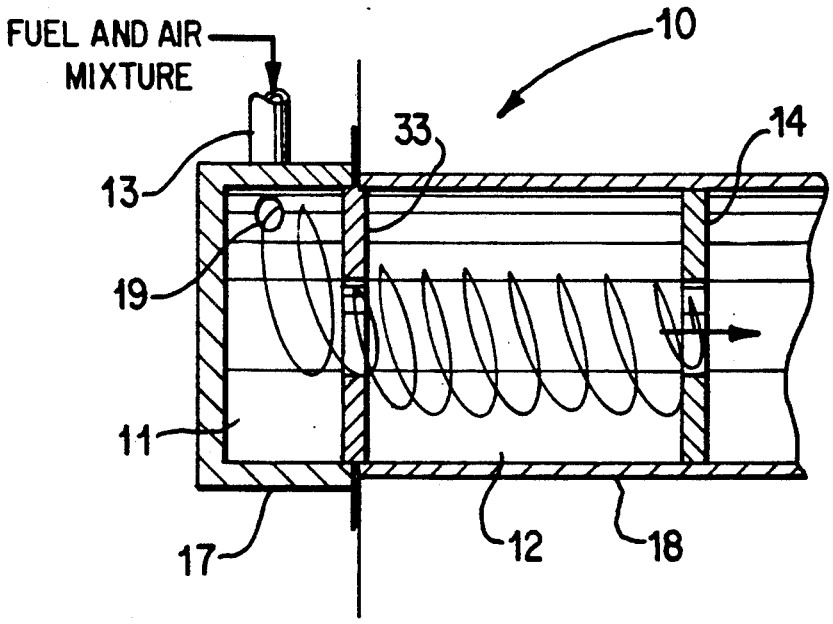
FIG. 1*c* is a cross-sectional side view of a cyclonic combustor in accordance with yet another embodiment of this invention.

In accordance with another embodiment of this invention as shown in FIG. 1*b*, orifice 33 is disposed at a downstream end of first combustor chamber 11, thereby intensifying combustion in first combustor chamber 11, and reducing residence time of the gases therein, thereby reducing the time available for $NO_x$ formation. In accordance with yet another embodiment of this invention as shown in FIG. 1*c*, orifice 33 is disposed at a downstream end of first combustor chamber 11 and orifice 14 is disposed at a downstream end of second combustor chamber 12.

Figure 5:
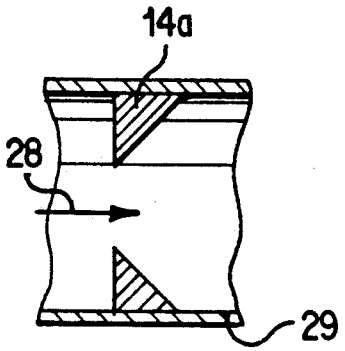
FIG. 5 is a cross-sectional side view of an orifice for a cyclonic combustor in accordance with one embodiment of this invention.
Figure 6:
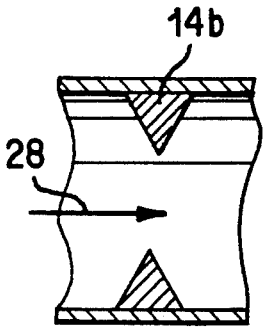
FIG. 6 is a cross-sectional side view of an orifice for a cyclonic combustor in accordance with another embodiment of this invention.
Figure 7:
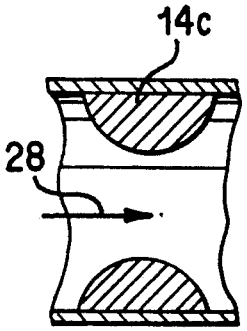
FIG. 7 is a cross-sectional side view of an orifice for a cyclonic combustor in accordance with yet another embodiment of this invention.

As shown in FIGS. 1, 1*a*, 1*b* and 1*c*, orifices 14, 33 are substantially cylindrical in shape and are concentrically aligned with substantially cylindrical first combustor chamber 11 and second combustor chamber 12. FIGS. 5, 6 and 7 show different embodiments of orifice 14 for enhancing internal recirculation of combustion products within cyclonic combustor 10, for increasing downstream convective heat transfer, and for minimizing pressure losses. Similar configurations may also be applied to orifice 33. In particular, orifice 14*a*, for a combustion gas flow in the direction indicated by arrow 28, promotes expansion of the swirling combustion products as they pass through orifice 14*a*. This, in turn, promotes contact of wall 29 downstream of orifice 14*a* by the hot combustion gases, thereby enhancing heat transfer through wall 29.

Orifice 14*c*, as shown in FIG. 7, reduces pressure losses resulting from passage of the combustion gases through orifice 14*c*.

Figure 2:
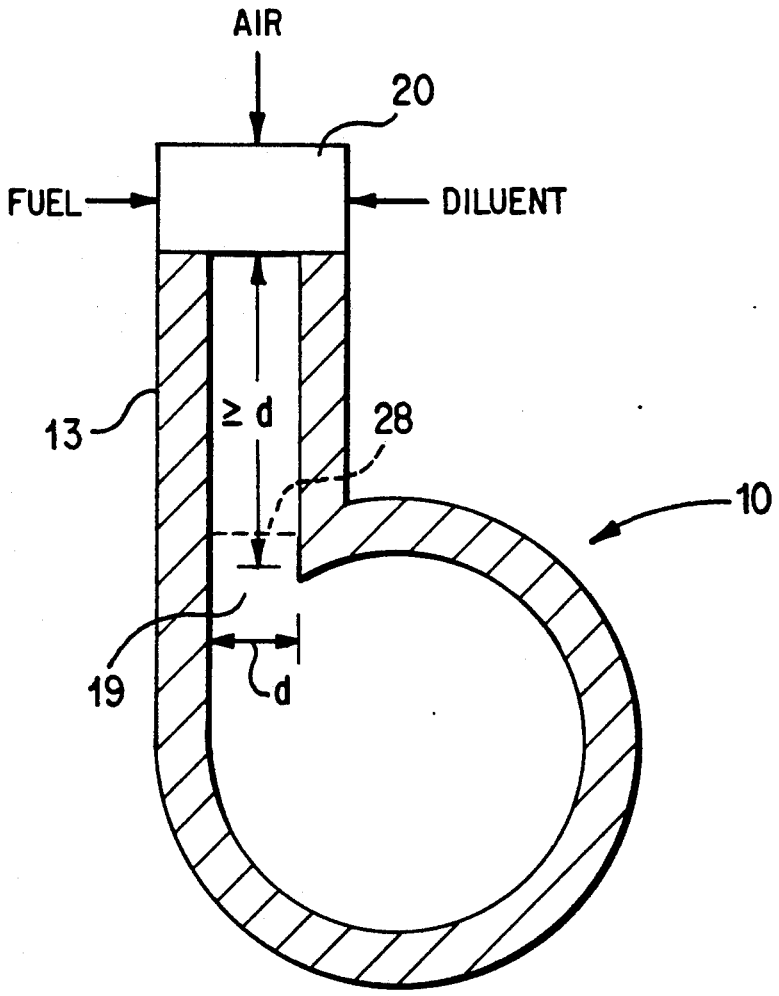
FIG. 2 is a view of the embodiment shown in FIG. 1 along section I—I.

FIG. 2 is a cross-sectional view of the cyclonic combustor in accordance with the embodiment shown in FIG. 1 in the direction of the arrows I—I. Shown in particular is the connection of nozzle 13 to first combustor chamber wall 17 such that the mixture of fuel and air is tangentially injected into first combustor chamber 11, imparting a swirling pattern to the combustion gases in first combustor chamber 11. To ensure complete mixing of the fuel and air prior to injection into first combustor chamber 11, the input end of nozzle 13 is in communication with means for premixing said fuel and air 20. Also to ensure complete mixing of the fuel and air, said means for premixing said fuel and air are located at least one nozzle equivalent diameter "d" upstream of nozzle exit 19 which is in communication with first combustor chamber 11.

In accordance with one embodiment of this invention, said means for premixing said fuel and air 20 comprises means for mixing a diluent with at least one of said fuel, said air and said mixture of fuel and air prior to tangential injection into first combustor chamber 11. Suitable diluents include air, recirculated flue gases, water, steam and mixtures thereof. It will be apparent to those skilled in the art that other diluents which decrease flame temperature in the first chamber may also be used.

To prevent flame flashback from first combustor chamber 11 into nozzle 13, cyclonic combustor 10, in accordance with one embodiment of this invention, is provided with means for preventing flashback. In accordance with one embodiment of this invention, said means for preventing flashback comprise flame arrestor 28 in the form of a screen disposed in nozzle 13 as shown in FIG. 2.

Figure 8:
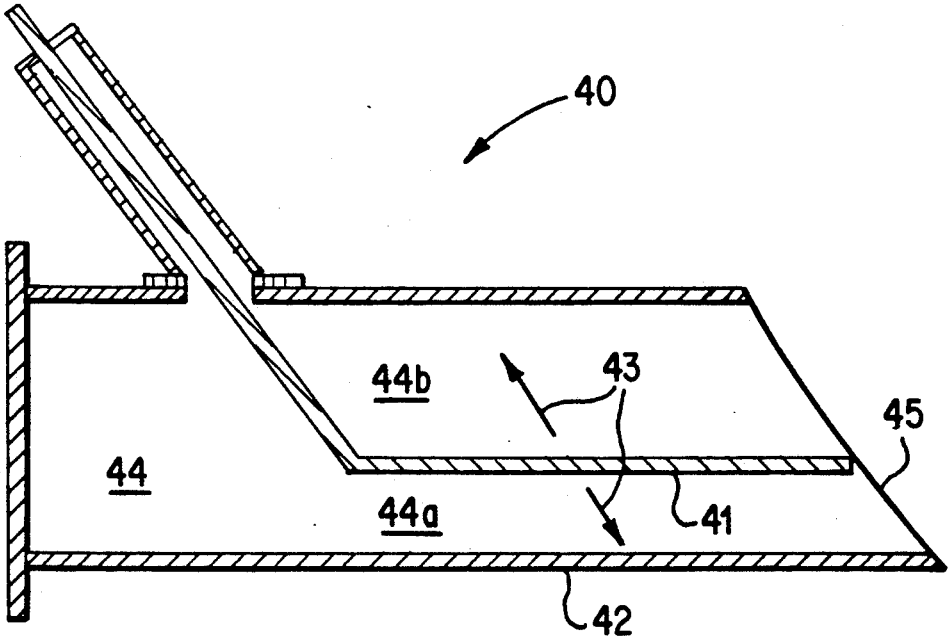
FIG. 8 is a cross-sectional side view of a controlled velocity nozzle for controlling flame flashback in accordance with one embodiment of this invention.

In accordance with another embodiment of this invention, said means for preventing flashback comprises means for controlling the velocity of the mixture of fuel and air, such as controlled velocity nozzle 40 shown in FIG. 8. Controlled velocity nozzle 40 comprises nozzle wall 42 forming nozzle chamber 44 having exit end 45 through which the mixture of fuel and air, and, if desired, diluents, is injected into cyclonic combustor 10. Disposed within nozzle chamber 44 is a means for adjusting the cross-sectional area of exit end 45. As shown in FIG. 8, such means for adjusting the cross-sectional area of exit end 45 of controlled velocity nozzle 40 is velocity controller 41 which separates nozzle chamber 44 into two parts 44*a* and 44*b*. Velocity controller 41 is moveable in the direction of arrows 43. As velocity controller 41 is moved to reduce the cross-sectional area of part 44*a* of nozzle chamber 44, the velocity of the mixture flowing from 44*a* of nozzle chamber 44 through exit end 45 of controlled velocity nozzle 40 increases.

Figure 3:
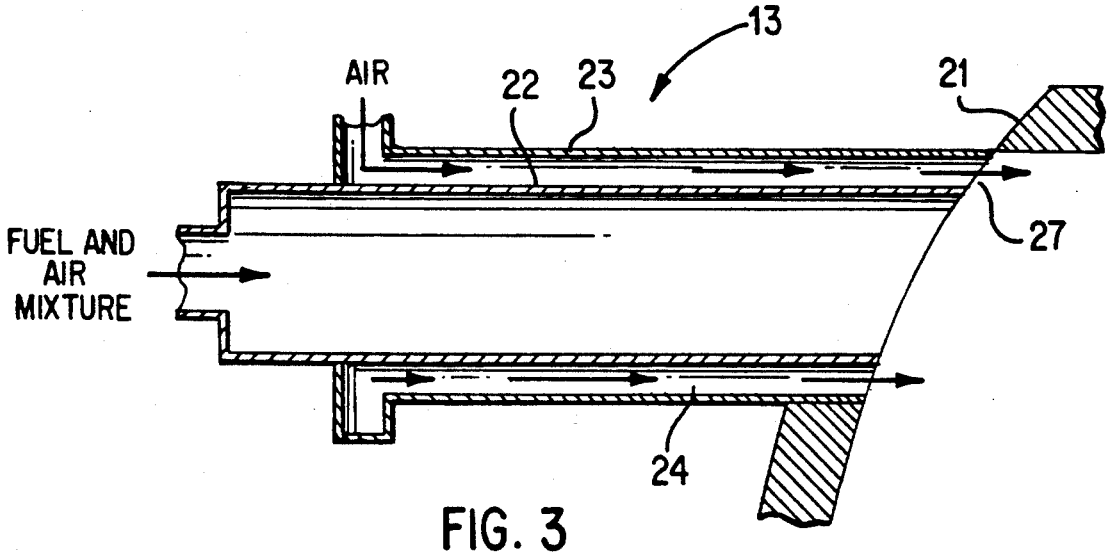
FIG. 3 is a cross-sectional side view of a nozzle for a cyclonic combustor in accordance with one embodiment of this invention.
Figure 4:
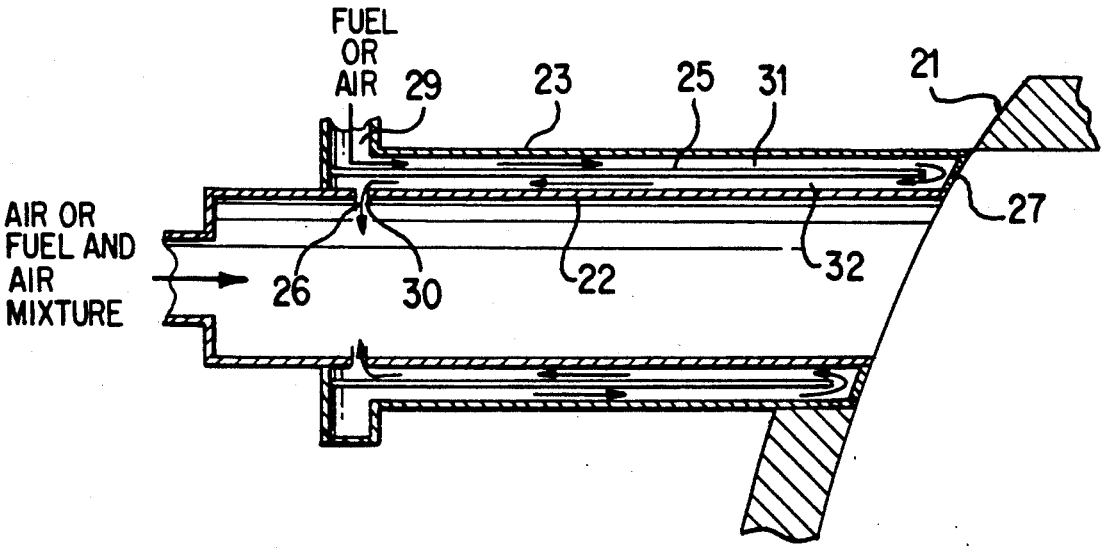
FIG. 4 is a cross-sectional side view of a nozzle for a cyclonic combustor in accordance with another embodiment of this invention.

In yet another embodiment of this invention, said means for preventing flashback comprises means for cooling the nozzle tip. Nozzle 13 is shown in FIG. 3 in accordance with one embodiment of this invention comprising nozzle wall 22 which forms a nozzle chamber through which a mixture of fuel and air, and, optionally, diluent, is injected through combustor wall 21 into first combustor chamber 11. Disposed around nozzle wall 22 is outer nozzle wall 23 forming annular chamber 24 between nozzle wall 22 and outer nozzle wall 23. Annular chamber 24 is in communication with a supply for a cooling fluid, preferably air. The end of annular chamber 24 proximate nozzle exit 19, namely annular chamber downstream end 27, is open, thereby permitting air which is introduced at an upstream end of annular chamber 24 to flow into first combustor chamber 11, cooling nozzle 13 as it passes through annular chamber 24.

In accordance with another embodiment of this invention, annular chamber downstream end 27, is closed off. Disposed within annular chamber 24 is inner nozzle wall 25 substantially parallel to outer nozzle wall 23 and nozzle wall 22. The end of inner nozzle wall 25 proximate nozzle exit 19 is at a distance from closed annular chamber downstream end 27, forming inner annular chamber 32 between inner nozzle wall 25 and nozzle wall 22 and outer annular chamber 31 between inner nozzle wall 25 and outer nozzle wall 23. Disposed in outer nozzle wall 23 distal from first combustor chamber 11 is cooling fluid inlet opening 29. Nozzle wall 22 is provided with cooling fluid outlet opening 30 distal from nozzle exit 19. As a result, cooling fluid, preferably air or fuel, introduced through cooling fluid inlet opening 29, flows through outer annular chamber 31, inner annular chamber 32 and exits through cooling fluid outlet opening 30 into nozzle 13. The cooling of nozzle 13 effected by the flowing cooling fluid reduces nozzle temperatures and thus controls flashback.

A process for cyclonic combustion of fuel in a boiler and heater in accordance with this invention comprises mixing the fuel and oxidant to form a fuel/oxidant mixture, tangentially injecting the fuel/oxidant mixture into a first combustor chamber, first chamber 17 in FIG. 1, at an upstream end of the first combustor chamber, igniting the fuel/oxidant mixture producing combustion products, exhausting the combustion products at a downstream end of a second combustor chamber, second chamber 18 in FIG. 1, concentrically aligned and in fluid communication with the first combustor chamber, and cooling a wall of the second combustor chamber.

In accordance with one embodiment of the process of this invention, the preferred oxidant is air. To control the formation of $NO_x$ emissions, the fuel/oxidant mixture comprises about 105% to about 160% of the oxidant required for complete combustion of the fuel. In accordance with another embodiment of the process of this invention, the fuel, oxidant or fuel/oxidant mixture is mixed with a diluent prior to tangential injection into the first combustion chamber. Said diluent may be air, recirculated flue gases, water, steam and mixtures thereof.

While in foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for cyclonic combustion of fuel and oxidant comprising:

mixing said fuel and said oxidant forming a fuel/oxidant mixture;

tangentially injecting said fuel/oxidant mixture into a first combustor chamber at an upstream end of said first combustor chamber;

igniting said fuel/oxidant mixture producing combustion products;

exhausting said combustion products through a second combustor chamber concentrically aligned and in fluid communication with said first combustor chamber; and cooling a wall of said second combustor chamber.

2. A process in accordance with claim 1, wherein said combustion products are exhausted through a concentrically aligned orifice at a downstream end of said second combustor chamber.

3. A process in accordance with claim 1, wherein said oxidant is air.

4. A process in accordance with claim 1, wherein said fuel/oxidant mixture comprises about 105% to about 160% of the oxidant required for complete combustion of said fuel.

5. A process in accordance with claim 1, wherein a diluent is mixed with at least one of said fuel, said oxidant, and said fuel/oxidant mixture prior to tangential injection into said first combustor chamber.

6. A process in accordance with claim 1, wherein said diluent is selected from the group consisting of air, recirculated flue gases, water, steam and mixtures thereof.

7. A cyclonic combustor comprising:

at least one first combustor chamber wall defining a first combustor chamber, said first combustor chamber having an upstream end, a downstream end and a substantially cylindrical longitudinally extending outer wall, said first combustor chamber being substantially uncooled;

at least one second combustor chamber wall defining a second combustor chamber having an upstream end, a downstream end and a substantially cylindrical longitudinally extending outer wall, said downstream end of said first combustor chamber in fluid communication with and substantially longitudinally aligned with said upstream end of said second combustor chamber, said second combustor chamber being substantially cooled; and tangential injection means for tangentially injecting a mixture of fuel and oxidant into said first combustor chamber secured to said first combustor chamber wall.

8. A cyclonic combustor in accordance with claim 7, wherein an orifice wall is secured to said second combustor chamber wall proximate said downstream end of said second combustor chamber, said orifice wall having an opening concentrically aligned with said second combustor chamber.

9. A cyclonic combustor in accordance with claim 8, wherein said opening has an opening diameter less than an inside diameter of said second combustor chamber.

10. A cyclonic combustor in accordance with claim 8, wherein said opening in said orifice wall is longitudinally non-cylindrical.

11. A cyclonic combustor in accordance with claim 7, wherein a first orifice wall is secured to said first combustor chamber wall proximate said downstream end of said first combustor chamber, said first orifice wall having a first orifice wall opening concentrically aligned with said first combustor chamber.

12. A cyclonic combustor in accordance with claim 11, wherein a second orifice wall is secured to said second combustor chamber wall proximate said downstream end of said second combustor chamber, said second orifice wall having a second orifice wall opening concentrically aligned with said second combustion chamber.

13. A cyclonic combustor in accordance with claim 12, wherein said first orifice wall opening has a diameter less than the inside diameter of said first combustor chamber and said second orifice wall opening has a diameter less than the inside diameter of said second combustor chamber.

14. A cyclonic combustor in accordance with claim 12, wherein at least one of said first orifice wall opening and said second orifice wall opening is longitudinally non-cylindrical.

15. A cyclonic combustor in accordance with claim 11, wherein said first orifice wall opening has a diameter less than an inside diameter of said first combustor chamber.

16. A cyclonic combustor in accordance with claim 7, wherein said tangential injection means for tangentially injecting said mixture of fuel and oxidant comprises means for mixing said fuel and said oxidant.

17. A cyclonic combustor in accordance with claim 16, wherein said means for mixing said fuel and said oxidant is in communication with at least one nozzle having a nozzle exit in communication with said first combustor chamber and is disposed at least one nozzle inner diameter equivalent upstream of said nozzle exit.

18. A cyclonic combustor in accordance with claim 16, wherein said tangential injection means further comprises means for mixing a diluent with at least one of said fuel, said oxidant and said mixture of fuel and oxidant.

19. A cyclonic combustor in accordance with claim 18, wherein said diluent is selected from the group consisting of air, recirculated flue gases, water, steam and mixtures thereof.

20. A cyclonic combustor in accordance with claim 7 further comprising means for preventing flame flashback.

21. A cyclonic combustor in accordance with claim 20, wherein said means for preventing flashback comprises a flame arrestor disposed in said tangential injection means for tangentially injecting said mixture of fuel and oxidant.

22. A cyclonic combustor in accordance with claim 20, wherein said tangentially injection means comprises said means for preventing flame flashback, said means for preventing flame flashback comprising a controlled velocity nozzle.

23. A cyclonic combustor in accordance with claim 7, wherein said tangential injection means comprises at least one nozzle having a nozzle wall forming a nozzle exit in communication with said first chamber.

24. A cyclonic combustor in accordance with claim 23, wherein said nozzle comprises means for cooling said nozzle.

25. A cyclonic combustor in accordance with claim 24, wherein said means for cooling said nozzle comprises an outer nozzle wall disposed around said nozzle wall forming an annular chamber around said nozzle.

26. A cyclonic combustor in accordance with claim 25, wherein said annular chamber is open at an annular chamber end toward said first combustor chamber.

27. A cyclonic combustor in accordance with claim 25, wherein said annular chamber is closed at an annular chamber end toward said first combustor chamber and an inner nozzle wall is disposed around said nozzle between said outer nozzle wall and said nozzle wall, substantially parallel to said outer nozzle wall and having an inner nozzle wall end towards said first combustor chamber at a distance from said closed end of said annular chamber, forming an inner annular chamber between said inner nozzle wall and said nozzle wall and an outer annular chamber wall between said inner nozzle wall and said outer nozzle wall.

28. A cyclonic combustor in accordance with claim 27, wherein said outer annular chamber wall forms a cooling fluid inlet opening distal from said first combustor chamber and said nozzle wall forms a cooling fluid outlet opening distal from said first combustor chamber whereby a cooling fluid introduced through said cooling fluid inlet opening flows through said outer annular chamber, said inner annular chamber and exits through said cooling fluid outlet opening.

* * * * *